United States Patent [19]

Scholles et al.

[11] Patent Number: 4,776,278

[45] Date of Patent: Oct. 11, 1988

[54] EXPLOSIVE CHARGE HAVING A PROJECTILE FORMING INSERT

[75] Inventors: Herbert Scholles, Meerbusch; Jürgen Böcker, Oberhausen; Torsten Niemeyer, Hilden, all of Fed. Rep. of Germany

[73] Assignee: Rheinmetall GmbH, Düsseldorf, Fed. Rep. of Germany

[21] Appl. No.: 25,044

[22] Filed: Mar. 12, 1987

[30] Foreign Application Priority Data

Mar. 12, 1986 [DE] Fed. Rep. of Germany ..... 3608198

[51] Int. Cl.[4] ..... F42B 1/02

[52] U.S. Cl. ..... 102/307; 102/309; 102/476

[58] Field of Search ..... 102/306–310, 102/476

[56] References Cited

U.S. PATENT DOCUMENTS

| | | | |
|---|---|---|---|
| 3,913,488 | 10/1975 | Dunetz et al. | 102/92.1 |
| 4,043,266 | 2/1976 | Held | 102/24 HC |
| 4,300,453 | 11/1981 | Bigler | 102/307 |
| 4,305,333 | 12/1981 | Altenau | 102/306 |
| 4,354,433 | 10/1982 | Owen | 102/310 X |
| 4,463,678 | 8/1984 | Weimer et al. | 102/309 X |
| 4,499,830 | 2/1985 | Majerus et al. | 102/309 X |
| 4,590,861 | 5/1985 | Bügiel | 102/501 |

FOREIGN PATENT DOCUMENTS

| | | |
|---|---|---|
| 2508270 | 2/1975 | Fed. Rep. of Germany . |
| 3317352 | 5/1983 | Fed. Rep. of Germany . |

*Primary Examiner*—Peter A. Nelson

*Attorney, Agent, or Firm*—Spencer & Frank

[57] ABSTRACT

An explosive charge including a body and an insert disposed within the body and having given regions which are uniformly distributed around the center of the insert which differ from their respective immediately adjacent regions for forming, upon explosive conversion of the charge, a rod-shaped projectile which has a tail end with shaped portions for providing aerodynamic stabilization of the trajectory of the projectile. The insert is fastened to the body in an essentially band-shaped contact zone disposed between the insert and the body so that there exists between the insert and the body a strong force transfer capability at the given regions and a weaker to negligible force transfer capability between the given regions.

10 Claims, 1 Drawing Sheet

EXPLOSIVE CHARGE HAVING A PROJECTILE FORMING INSERT

BACKGROUND OF THE INVENTION

The present invention relates to an explosive charge including a body and an insert disposed with the body, the insert having given regions which are uniformly distributed around the center of the insert which differ from their respective immediately adjacent regions for forming, upon explosive conversion of the charge, a rod-shaped projectile which has a tail end with shaped portions for providing aerodynamic stabilization of the trajectory of the projectile.

A charge of this type is disclosed in German Patent No. 3,317,352 and corresponding U.S. Pat. No. 4,590,861 to Horst G. Bügiel. In this charge, the wall thickness of the insert is made different in different regions so as to assure the appropriate shaping at the tail of the projectile.

This charge has the drawback that it is costly to manufacture and the costs do not justify the results in that disturbing, and thus damaging, material separations cannot be avoided.

SUMMARY OF THE INVENTION

It is an object of the invention to provide an explosive charge of the foregoing type which is distinguished by comparatively low expenditures and good results.

The above and other objects are accomplished in the context of an explosive charge of the type first described above, wherein, according to the invention there is provided a means for fastening the insert to the body of the charge in an essentially band-shaped contact zone disposed between the insert and the body so that there exists between the insert and the body a strong force transfer capability at the given regions and a weaker to negligible force transfer capability between the given regions.

BRIEF DESCRIPTION OF THE DRAWINGS

The invention will be described in greater detail below with reference to an embodiment illustrated in the drawings, wherein.

DESCRIPTION OF THE PREFERRED EMBODIMENT

Figure 1:
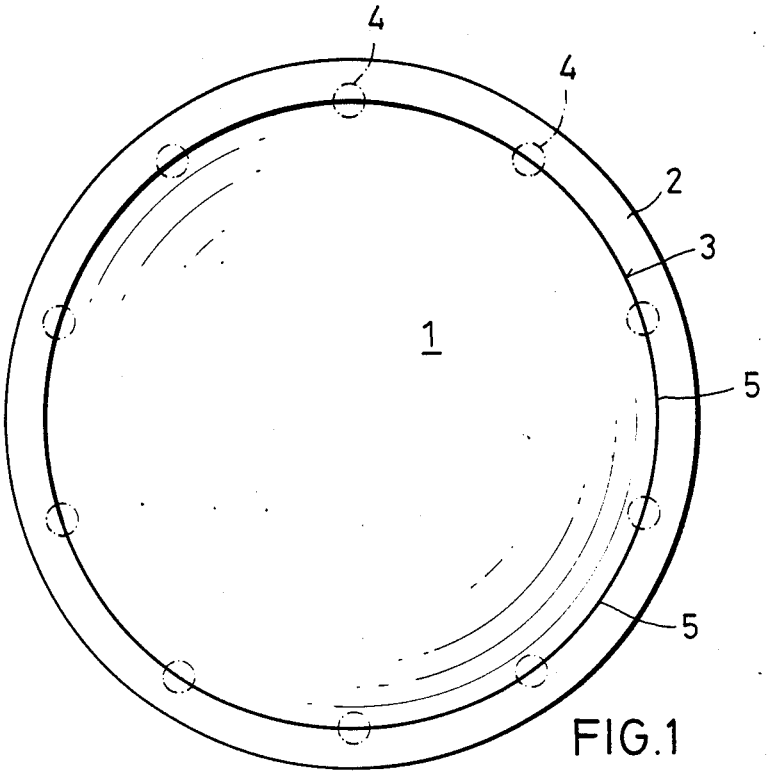
FIG. 1 is a top view of the insert in an explosive charge according to the invention.
Figure 2:
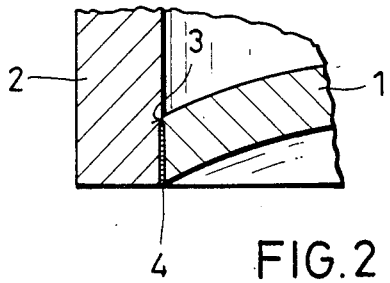
FIG. 2 is a sectional detail view to a larger scale showing one of the regions of FIG. 1 having a strong force transfer capability.

Referring to FIGS. 1 and 2, there is shown a rotationally symmetrical insert 1 connected with a body 2 of an explosive charge in regions 4 of a contact zone 3 so that a strong friction-type, form locking or other type of connection having a strong force transfer capability exists between insert 1 and body 2 at such regions 4. In the area 5 between regions 4, there exists a connection having a comparatively lower to negligible force transfer capability between insert 1 and body 2. Adhesive or shrink connections, joining by means of welding according to different methods and hard soldering are additionally suitable for fastening insert 1 to body 2 at regions 4. If a connection between insert 1 and body 2 should also be necessary in the area 5 between regions 4, then this connection differs from those within regions 4 by a reduced force transfer capability.

The configuration of regions 4 can be adapted very easily, in number and extent in the axial, radial and circumferential directions, to the respective requirements and the elected fastening method.

Although German Auslegeschrift [published patent application] No. 2,508,270 and corresponding U.S. Pat. No. 4,043,266 to Manfred Held mentions that similar charges having prefabricated inserts which are welded or glued into a body are known, they are there described as being complicated, costly to manufacture and subject to malfunction. However, the teaching according to the present invention goes beyond this negative evaluation in the art and arrives unexpectedly at a result which, according to the above mentioned prior art, was attainable only at significantly greater expense.

The present disclosure relates to the subject matter disclosed in German No. P 36 08 198.1 of Mar. 12th, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In an explosive charge including a body containing explosive material and an insert disposed within a circular opening in the body and having given regions which are uniformly distributed around a periphery of the insert for forming, upon explosive conversion of the insert, a rod-shaped projectile which has a tail end with shaped portions for providing aerodynamic stabilization of the trajectory of the projectile, the improvement wherein said insert is rotationally symmetrical and further comprising:

means for fastening said insert in an essentially band-shaped contact zone disposed between said periphery of said insert and said body so that there exists between said insert and said body a strong force transfer capability at said given regions within said contact zone and a weaker to negligible force transfer capability in regions between said given regions within said contact zone.

2. Explosive charge as defined by claim 1, wherein said means for fastening comprises friction-type connections.

3. Explosive charge as defined by claim 1, wherein said means for fastening comprises form locking connections.

4. Explosive charge as defined by claim 1, wherein said means for fastening comprises adhesive connections.

5. Explosive charge as defined by claim 1, wherein said means for fastening comprises welding connections.

6. Explosive charge as defined by claim 1, wherein said means for fastening comprises soldering connections.

7. Explosive charge as defined by claim 1, wherein said means for fastening comprises shrink connections.

8. An explosive charge comprising; a body filled with explosive material and having at least one circular opening; a rotationally symmetrical insert having a circular periphery disposed within said opening; and means for fastening said periphery of said insert to said body, such that a strong force transfer capability exists between said insert and said body at given regions distributed uniformly about said periphery and a weaker to negligible force transfer capability exists between said insert and said body at regions about said periphery between said given regions, whereby upon explosive conversion of said insert a rod-shaped projectile which has a tail end with shaped portions for providing aerodynamic stabilization of the trajectory of the projectile is formed, with said given regions producing outer fin tips in the tail end of the rod-shaped projectile and said regions between said given regions forming fin bases which are retracted toward the rod-shaped projectile.

9. An explosive charge as defined in claim 8, wherein; said body is a cylindrical-shaped explosive projectile and said opening and said insert are provided on a circular front side of said cylindrical-shaped explosive projectile.

10. In an explosive charge including a body containing explosive material and having a circular opening therein, a rotationally symmetrical insert of uniform cross-section disposed within said opening, and fastening means for fastening said insert in said opening forming an essentially band-shaped contact zone about a periphery of said insert; the improvement wherein said fastening means comprises means for providing a strong force transfer capability at given regions uniformly distributed about said periphery of said insert within said contact zone and for providing a weaker to negligible force transfer capability at regions between said given regions within said contact zone such that upon explosive conversion of said insert, said insert forms a rod-shaped projectile with said given regions producing outer fin tips in a tail end of the projectile and said regions between said given regions producing fin bases which are retracted toward the rod-shaped projectile for providing aerodynamic stabilization to the formed projectile.

* * * * *